United States Patent [19]

Yamamoto et al.

[11] Patent Number: 4,949,125

[45] Date of Patent: Aug. 14, 1990

[54] METHOD AND APPARATUS FOR COLOR ELECTROPHOTOGRAPHY

[75] Inventors: Hajime Yamamoto, Osaka; Kazunori Kitagaki, Utsunomiya; Masahiko Nakamura, Osaka, all of Japan

[73] Assignee: Matsushita Electric Industrial Co., Ltd., Osaka, Japan

[21] Appl. No.: 261,072

[22] Filed: Oct. 21, 1988

[30] Foreign Application Priority Data

Oct. 27, 1987 [JP] Japan ..... 62-270664
Dec. 25, 1987 [JP] Japan ..... 62-330818

[51] Int. Cl.[5] ..... G03G 15/01; G03G 15/08

[52] U.S. Cl. ..... 355/219; 355/246; 355/261; 355/265; 355/266; 355/327

[58] Field of Search ..... 355/327, 261, 266, 246, 355/326, 225, 319, 219, 221, 222, 223, 265, 251; 430/42, 44, 46, 47, 54

[56] References Cited

U.S. PATENT DOCUMENTS 4,599,285 7/1986 Haneda et al. ..... 430/54
4,611,901 9/1986 Kohyama et al. ..... 355/225
4,731,313 3/1988 Haneda ..... 355/251 X

FOREIGN PATENT DOCUMENTS 0240888 10/1987 European Pat. Off. .
59-38762 3/1984 Japan ..... 355/327
61-73971 4/1986 Japan .

*Primary Examiner*—A. C. Prescott
*Assistant Examiner*—Edward Pipala
*Attorney, Agent, or Firm*—Lowe, Price, LeBlanc, Becker & Shur

[57] ABSTRACT

A charging process, an exposure process, and a development process are performed to form a toner image on a photosensitive member for each of a plurality of different colors. The toner images for the respective colors form a composite color image. The composite color image is transferred to a sheet. A potential of toner on the photosensitive member is varied before the development process for a final color is performed. The colors may be yellow, magenta, and cyan respectively.

23 Claims, 3 Drawing Sheets

METHOD AND APPARATUS FOR COLOR ELECTROPHOTOGRAPHY

BACKGROUND OF THE INVENTION

This invention relates to a method and an apparatus for color electrophotography.

In some methods of color electrophotography, toner images of different colors are formed by repeating charging, exposure, and development, and then the toner images are transferred to a sheet together to form a final color image. Apparatuses using such methods dispense with image transfer drums and are thus small. It is desirable to increase color characteristics of the final image.

SUMMARY OF THE INVENTION

It is an object of this invention to provide an excellent method and an excellent apparatus for color electrophotography.

In accordance with this invention, a charging process, an exposure process, and a development process are performed to form a toner image on a photosensitive member for each of a plurality of different colors. The toner images for the respective colors form a composite color image. The composite color image is transferred to a sheet. A potential of toner on the photosensitive member is varied before the development process for a final color is performed. The colors may be yellow, magenta, and cyan respectively.

DESCRIPTION OF THE PREFERRED EMBODIMENTS

This invention is an improvement of an apparatus for color electrophotography, which will be described hereinafter with reference to FIGS. 1 and 2 for a better understanding of this invention. It should be noted that the apparatus of FIGS. 1 and 2 is not a prior art to this invention.

Figure 1:
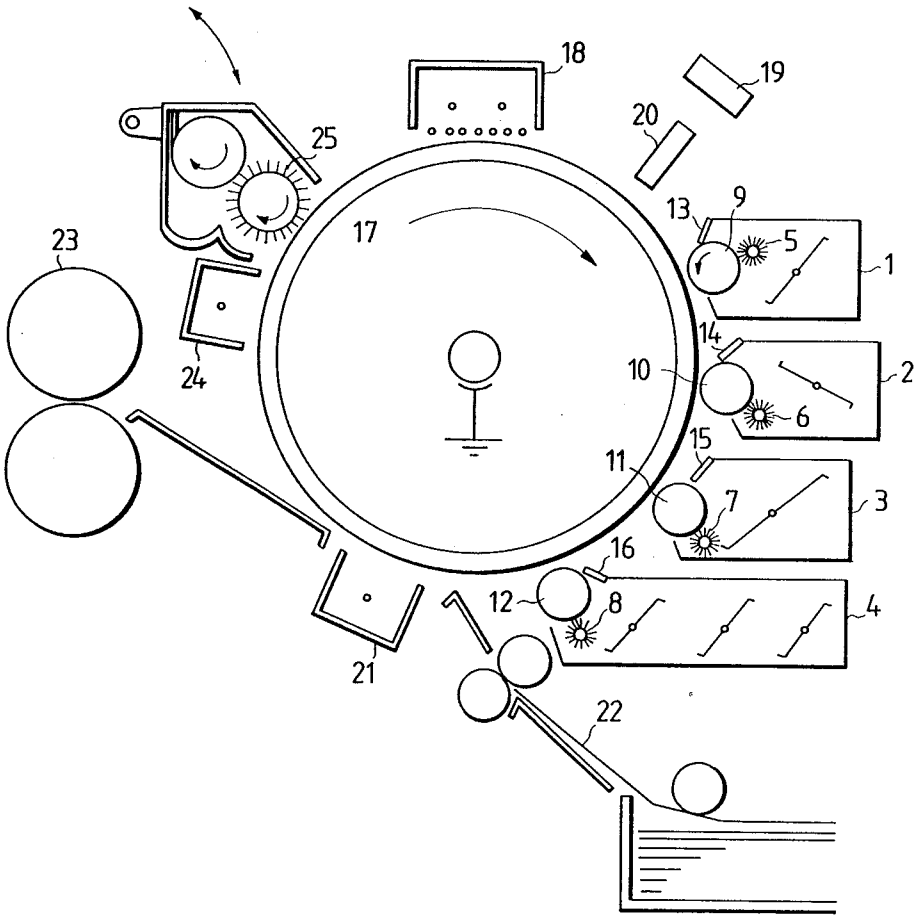
FIG. 1 is a diagram of an apparatus for color electrophotography.
Figure 2:
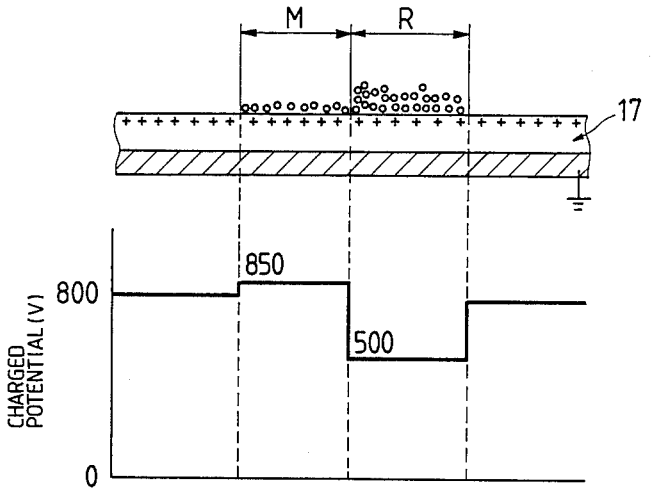
FIG. 2 is a diagram showing the relationship between different color portions of a photosensitive member and charged potentials of these portions in the apparatus of FIG. 1.

As shown in FIG. 1, the apparatus for color electrophotography includes noncontact and nonmagnetic development devices 1, 2, 3, and 4 forcing respective toners to fly with dc electric fields. The development devices 1, 2, 3, and 4 include electrically conductive fur brushes 5, 6, 7, and 8 in contact with aluminum developing rollers 9, 10, 11, and 12 respectively. During rotation of the developing rollers 9, 10, 11, and 12, the fur brushes 5, 6, 7, and 8 charge respective toners. Toners which are carried on the respective developing rollers 9, 10, 11, and 12 are formed into respective thin layers by blades 13, 14, 15, and 16. The development devices 1, 2, 3, and 4 contain yellow, magenta, cyan, and black toners respectively. The development devices 1, 2, 3, and 4 are located around a photosensitive cylindrical member 17. Each of the development devices 1, 2, 3, and 4 is moved into and held in a given position close to the photosensitive member 17 during a developing process for the corresponding color and is moved away from the given position during other periods. These movements of the development devices 1, 2, 3, and 4 are performed by a known selective drive mechanism.

The yellow development device 1 is designed as follows. The diameter of the developing roller 9 is 16 mm (millimeters). The developing roller 9 is rotated at a peripheral speed of 150 mm/s. The direction of rotation of the developing roller 9 is opposite to the direction of rotation of the photosensitive member 17. Accordingly, in a region where the developing roller 9 and the photosensitive member 17 oppose each other, the developing roller 9 and the photosensitive member 17 move essentially in a common direction. The thickness of a layer of toner on the developing roller 9 is 30 micrometers. The gap between opposing surfaces of the developing roller 9 and the photosensitive member 17 is 150 micrometers during a developing process for yellow and is 700 micrometers during other periods.

The toner used in the yellow development device 1 is designed as follows. The quantity of charge of the toner is +3 microcoulombs per gram. The toner includes particles, the average diameter of which is 10 micrometers. The relative dielectric constant of the tone is about 2.

The magenta development device 2, the cyan development device 3, and the black development device 4 are similar to the yellow development device 1. The toners used in the magenta development device 2, the cyan development device 3, and the black development device 4 are similar to the toner used in the yellow development device 1.

The photosensitive member 17 includes a drum made of photosensitive amorphous Se-Te having an enhanced sensitivity in an infrared range. The diameter of the photosensitive drum 17 is 100 mm. The drum 17 has a photosensitive layer with a thickness of 60 micrometers and a relative dielectric constant of 6.3. The photosensitive member 17 is rotated by a motor in a known way.

The apparatus of FIG. 1 operates as follows. The photosensitive member 17 is rotated at a peripheral speed of 150 mm/s. The photosensitive member 17 is charged to a surface voltage +700 by a corona charging device 18 in a first charging process. The charging device 18 includes a scorotron charger. During the first charging process, the charging device 18 is operated at a corona voltage of 7 KV and a grid voltage of 820 V. After the first charging process, the photosensitive member 17 undergoes first exposure and is thus exposed to light from a light-emitting diode array 19 which represents a yellow-related information signal. The wavelength of this light is 670 nm. The light is applied to the photosensitive member 17 via a commercially-available self-focusing lens array 20. During the first exposure, the intensity or power of the light on a surface of the photosensitive member 17 is set to 2.2 microjouls per centimeter square. The first exposure records the yellow-related information signal on the photosensitive member 17, forming a corresponding negative and thus forming an electrostatic latent image related to yellow. The yellow development device 1 is activated. The latent image is inversely developed into a corresponding yellow toner image by the yellow development device 1. During this development, the developing roller 9 of the yellow development device 1 is subjected to a positive potential of +600 V. The magenta development device 2, the cyan development device 3, and the black development device 4 are deactivated.

Next, the photosensitive member 17 is charged to a potential +850 by the charging device 18 in a second charging process. After the second charging process, the photosensitive member 17 undergoes second exposure and is thus exposed to the light from the light-emitting diode array 19 which represents a magenta-related information signal. The second exposure records the magenta-related information signal on the photosensitive member 17, forming a corresponding negative and thus forming an electrostatic latent image related to magenta. The magenta development device 2 is activated. The latent image is inversely developed into a corresponding magenta toner image by the magenta development device 2. During this development, the developing roller 10 of the magenta development device 2 is subjected to a positive potential of +700 V. The yellow development device 1, the cyan development device 3, and the black development device 4 are deactivated.

Subsequently, the photosensitive member 17 is charged to a potential +880 by the charging device 18 in a third charging process. After the third charging process, the photosensitive member 17 undergoes third exposure and is thus exposed to the light from the light-emitting diode array 19 which represents a cyan-related information signal. The third exposure records the cyan-related information signal on the photosensitive member 17, forming a corresponding negative and thus forming an electrostatic latent image related to cyan. The cyan development device 3 is activated. The latent image is inversely developed into a corresponding cyan toner image by the cyan development device 3. During this development, the developing roller 11 of the cyan development device 3 is subjected to a potential of +800 V. The yellow development device 1, the magenta development device 2, and the black development device 4 are deactivated.

Next, the photosensitive member 17 is charged to a potential +880 by the charging device 18 in a fourth charging process. After the fourth charging process, the photosensitive member 17 undergoes fourth exposure and is thus exposed to the light from the light-emitting diode array 19 which represents a black-related information signal. The fourth exposure records the black-related information signal on the photosensitive member 17, forming a corresponding negative and thus forming an electrostatic latent image related to black. The black development device 4 is activated. The latent image is inversely developed into a corresponding black toner image by the black development device 4. During this development, the developing roller 12 of the black development device 4 is subjected to a potential of +800 V. The yellow development device 1, the magenta development device 2, and the cyan development device 3 are deactivated. The yellow toner image, the magenta toner image, the cyan toner image, and the black toner image form a composite color toner image together on the photosensitive member 17.

The composite color toner image is transferred from the photosensitive member 17 to a sheet 22 by a transfer device 21. The sheet 22 which carries the composite color toner image is fed to a fusing device 23 by a suitable conveyor. The device 23 permanently affixes the composite color toner image to the sheet 22 in a thermal process.

After the composite color toner image is transferred from the photosensitive member 17 to the sheet 22, the surface of the photosensitive member 17 is charged to a positive potential by a charging device 24 and is then rubbed with an electrically conductive fur brush 25 so that the photosensitive member 17 is cleaned. During this cleaning process, the charging device 24 is operated at a corona voltage of +5.5 KV and the fur brush 25 is subjected to a voltage of −150 V.

It was experimentally found that as respective color image forming steps were repeated successively, red portions including the yellow and magenta toner tended to be contaminated by the cyan toner although the red portions were not exposed to the cyan-related information light. Accordingly, the color purity of the red portions tended to be decreased.

It was found that the decrease in the color purity of the red portions resulted from the following processes. As shown in FIG. 2, a photosensitive member 17 has a magenta portion M carrying only a magenta toner layer, a red portion R carrying a yellow toner layer and a magenta toner layer, and other portions free from any toner layers. When this photosensitive member 17 is uniformly subjected to corona charging from above the toner layers, the magenta portion M, the red portion R, and the other portions assume different potentials respectively. For example, the charged potential of the magenta portion M, the charged potential of the red portion R, and the charged potential of the other portions are 850 V, 500 V, and 800 V respectively. In this way, the charged potential of the red portion R is lower than the charged potentials of the other portions. Accordingly, in the case where the photosensitive member 17 is developed by the cyan development device 3 which is supplied with a developing bias of 800 V, the lower charged potential of the red portion R induces the cyan toner to be fixed to the red portion R although the red portion R was not exposed to cyan-related information light.

It was found that the decrease in the charged potential of the red portions depended on electrostatic hysteresis of the photosensitive member. It is well-known that the exposure of a selenium-based photosensitive member to infrared rays for a long time causes great electrostatic fatique in the photosensitive member. This is caused by the following processes. While a cycle of charging and exposure is periodically reiterated for a long time, minus charges gradually accumulate in the selenium-based photosensitive member. The minus charges cancel plus charges generated by the corona charging so that the charged potential of the photosensitive member drops. In the case of color electrophotography, there are much positively-charged toners on a photosensitive member and the charged toners increase an effective electric field to the photosensitive member, so that minus charges tend to accumulate in red portions of the photosensitive member.

This invention was carried out in view of the previously-mentioned drawback in the apparatus of FIGS. 1 and 2. This invention will be described in detail hereinafter.

In a first example of this invention, after the development related to a second of yellow, magenta, and cyan but before the charging related to a third of the three colors, a photosensitive member is exposed to ac corona or dc corona having a polarity opposite the polarity of charge of the photosensitive member. In the case where the developments related to yellow, magenta, and cyan are sequentially performed, after the magenta development but before the cyan charging, the photosensitive member is exposed to the ac corona or the dc corona. In the case where the developments related to magenta, yellow, and cyan are sequentially performed, after the yellow development but before the cyan charging, the photosensitive member is exposed to the ac corona or the dc corona. The exposure to the ac corona or the dc corona recovers the charging ability of the photosensitive member, preventing the charged potential of red portions from dropping. In a second example of this invention, the exposure to the ac corona or the dc corona continues while all of yellow, magenta, and cyan image forming steps are performed. The photosensitive member is of an amorphous selenium-based type or an amorphous selenium-arsenic-based type. In a third example of this invention, a minus charged photosensitive member such as an organic photosensitive member of an azo-based type or a phthalocyanine-based type is used in inverse development, and the photosensitive member is exposed to ac corona or dc plus corona. In a fourth example of this invention, two or three different color images are overlapped, and a photosensitive member is exposed to corona after first color development but before second color charging.

Figure 3:
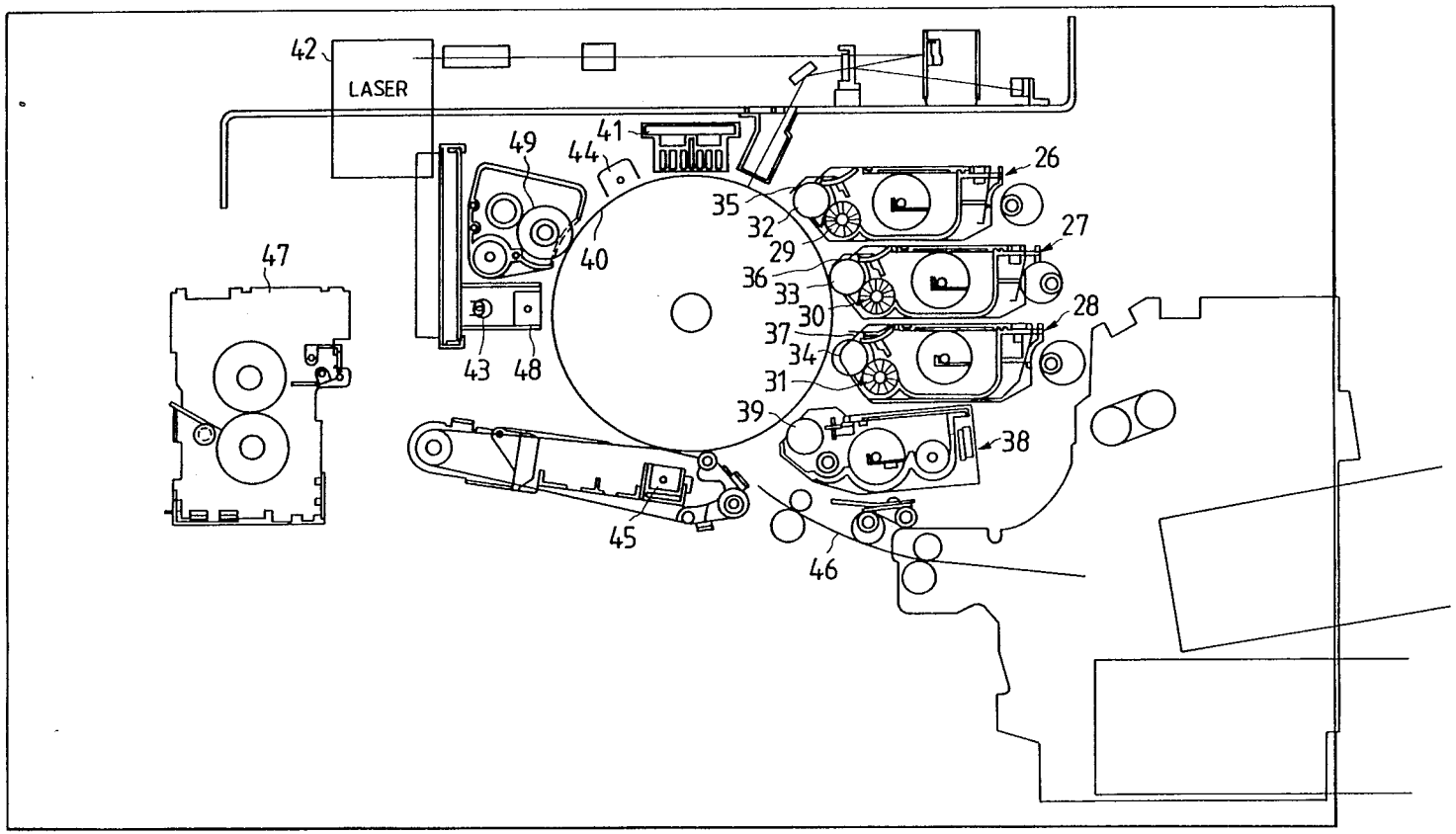
FIG. 3 is a diagram of an apparatus for color electrophotography according to a first embodiment of this invention.

With reference to FIG. 3, an apparatus for color electrophotography according to a first embodiment of this invention includes noncontact and nonmagnetic development devices 26, 27, and 28 which contain yellow, magenta, and cyan insulating toners respectively. The development devices 26, 27, and 28 use dc electric fields and thereby force the toners to fly. In the development devices 26, 27, and 28, electrically conductive fur brushes 29, 30, and 31 contact developing rollers 32, 33, and 34 made of aluminum respectively. The developing rollers 32, 33, and 34 are rotated by suitable drive mechanisms. During rotation of the developing rollers 32, 33, and 34, the fur brushes 29, 30, and 31 charge the toners in friction processes. The development devices 26, 27, and 28 also include blades 35, 36, and 37 which form thin layers of the toners on the developing rollers 32, 33, and 34 respectively. A development device 38 of a contact type contains developer having two components, that is, black insulating toner and magnetic carrier. The development device 38 includes a developing roller 39 which is rotated by a suitable drive mechanism. The development devices 26, 27, 28, and 38 are located around a cylindrical photosensitive member 40. Each of the development devices 26, 27, 28, and 38 is moved into and held in a given position close to the photosensitive member 40 during a developing process for the corresponding color and is moved away from the given position during other periods. These movements of the development devices 26, 27, 28, and 38 are performed by a known selective drive mechanism.

The black development device 38 is designed as follows. The diameter of the developing roller 39 is 22 mm (millimeters). The developing roller 39 is rotated at a peripheral speed of 320 mm/s. The thickness of a layer of developer on the developing roller 39 is 400 micrometers. The direction of rotation of the developing roller 39 is opposite to the direction of rotation of the photosensitive member 40. Accordingly, in a region where the developing roller 39 and the photosensitive member 40 oppose each other, the developing roller 39 and the photosensitive member 40 move essentially in a common direction. The gap between opposing surfaces of the developing roller 39 and the photosensitive member 40 is 300 micrometers during a developing process for black and is 2 millimeters during other periods.

The developer used in the black development device 38 is designed as follows. The developer has two components, that is, toner and carrier. The carrier includes particles, the average diameter of which is about 50 micrometers. The carrier is made of ferrite coated with Teflon. The quantity of charge of the toner is +10 microcoulombs per gram. The toner includes particles, the average diameter of which is 8 micrometers. The relative dielectric constant of the toner is about 2.

The yellow development device 26 is designed as follows. The diameter of the developing roller 32 is 20 mm. The developing roller 32 is rotated at a peripheral speed of 160 mm/s. The direction of rotation of the developing roller 32 is opposite to the direction of rotation of the photosensitive member 40. Accordingly, in a region where the developing roller 32 and the photosensitive member 40 oppose each other, the developing roller 32 and the photosensitive member 40 move essentially in a common direction. The thickness of a layer of toner on the developing roller 32 is 30 micrometers. The gap between opposing surfaces of the developing roller 32 and the photosensitive member 40 is 150 micrometers during a developing process for yellow and is 2 millimeters during other periods.

The toner used in the yellow development device 26 is designed as follows. The quantity of charge of the toner is +3 microcoulombs per gram. The toner includes particles, the average diameter of which is about 10 micrometers. The relative dielectric constant of the toner is about 2.

The magenta development device 27 and the cyan development device 28 are similar to the yellow development device 26. The toners used in the magenta development device 27 and the cyan development device 28 are similar to the toner of the yellow development device 26.

The photosensitive member 40 includes a drum made of photosensitive amorphous Se-Te having an enhanced sensitivity in an infrared range. The diameter of the photosensitive drum 40 is 152 mm. The photosensitive member 40 may include a layer of function separated photosensitive selenium-based material which has a enhanced sensitivity in a infrared range, a relative dielectric constant of about 7, and a thickness of 60 micrometers. The photosensitive member 40 is rotated by a motor in a known way.

A corona charging device 41 preferably composed of a scorotron charger serves to charge the photosensitive member 40 to adjustable potentials. An exposure device including a semiconductor laser 42 applies optical image information signals to the photosensitive member 40 to form corresponding electrostatic latent images on the photosensitive member 40. The semiconductor laser 42 emits light having a wavelength of 790 nm. A lamp 43 serves to remove charges from the photosensitive member 40. An ac corona charging device 44 serves to apply a predetermined ac potential to the photosensitive member 40. The charging device 44 includes an ac power supply. A transfer device 45 attracts a composite color toner image from the photosensitive member 40 to a sheet 46 supplied by a suitable feeder. A fusing device 47 uses a thermal process and thereby permanently affixes the composite color toner image to the sheet 46. A charging device 48 and an electrically conductive fur brush 49 cooperate to clean the photosensitive member 40. The device 48 charges the photosensitive member 40 to a positive potential. The fur brush 49 remains pressed in contact with the photosensitive member 40. The fur brush 49 is subjected to a predetermined negative potential.

The apparatus of FIG. 3 operates as follows. The photosensitive member 40 is rotated at a peripheral speed of 160 mm/s. The photosensitive member 40 is charged to a potential of +900 V by the charging device 41 in a first charging process. During the first charging process, the charging device 41 is operated at a corona voltage of +7 KV and a grid voltage of +1 KV. After the first charging process, the photosensitive member 40 undergoes first exposure and is thus exposed to the light from the semiconductor laser 42 which represents a black-related information signal. During the first exposure, the intensity or power of the light on a surface of the photosensitive member 40 is set to 1.0 mW. The first exposure records the black-related information signal on the photosensitive member 40, forming a corresponding negative and thus forming an electrostatic latent image related to black. The yellow development device 26, the magenta development device 27, and the cyan development device 28 are deactivated so that they will not act on the latent image. Only the black development device 38 is activated. The latent image is inversely developed into a corresponding black toner image by the black development device 38. During this development, the developing roller 39 of the black development device 38 is subjected to a potential of +600 V. After the development, the lamp 43 removes charges from the photosensitive member 40. At this time, the black toner image is formed by a toner layer having a thickness of 10–20 micrometers and having a single sub-layer or two sub-layers.

Next, the photosensitive member 40 is charged to a potential of +600 V by the charging device 41 in a second charging process. During the second charging process, the charging device 41 is operated at a corona voltage of +7 KV and a grid voltage of +600 V. As a result, portions of the photosensitive member 40 which carry the black toner assume a potential of +600 V. After the second charging process, the photosensitive member 40 undergoes second exposure and is thus exposed to the light from the semiconductor laser 42 which represents a yellow-related information signal. During the second exposure, the intensity or power of the light on a surface of the photosensitive member 40 is set to 1.5 mW. The second exposure records the yellow-related information signal on the photosensitive member 40, forming a corresponding negative and thus forming an electrostatic latent image related to yellow. The yellow development device 26 is activated. The latent image is inversely developed into a corresponding yellow toner image by the yellow development device 26. During this development, the developing roller 32 of the yellow development device 26 is subjected to a potential of +600 V. The magenta development device 27, the cyan development device 28, and the black development device 38 are deactivated. In addition, the lamp 43 is deactivated so that it will not remove charges from the photosensitive member 40.

Subsequently, the photosensitive member 40 is charged to a potential of +810 V by the charging device 41 in a third charging process. During the third charging process, the charging device 41 is operated at a corona voltage of +7 KV and a grid voltage of +800 V. As a result, portions of the photosensitive member 40 which carry the black and yellow toners assumes a potential of +810 V. After the third charging process, the photosensitive member 40 undergoes third exposure and is thus exposed to the light from the semiconductor laser 42 which represents a magenta-related information signal. The third exposure records the magenta-related information signal on the photosensitive member 40, forming a corresponding negative and thus forming an electrostatic latent image related to magenta. The yellow development device 26, the cyan development device 28, and the black development device 38 are deactivated. Only the magenta development device 27 is activated. The latent image is inversely developed into a corresponding magenta toner image by the magenta development device 27. During this development, the developing roller 33 of the magenta development device 27 is subjected to a potential of +800 V. Portions of the photosensitive member 40 in which the yellow toner and the magenta toner overlap are formed with a toner layer having a thickness of 20–40 micrometers and having two or four sub-layers.

Next, the photosensitive member 40 is exposed to an ac corona potential of 5 KV rms by the ac corona charging device 44 and is then charged to a potential of +800 V by the charging device 41 in a fourth charging process. As a result of the fourth charging process, portions of the photosensitive member 40 which carry either of the black, yellow, and magenta toners assume a potential of +800 V. In addition, red portions of the photosensitive member 40 in which the yellow toner and the magenta toner overlap assume a potential of +800 V. After the fourth charging process, the photosensitive member 40 undergoes fourth exposure and is thus exposed to the light from the semiconductor laser 42 which represents a cyan-related information signal. The fourth exposure records the cyan-related information signal on the photosensitive member 40, forming a corresponding negative and thus forming an electrostatic latent image related to cyan. The yellow development device 26, the magenta development device 27, and the black development device 38 are deactivated. Only the cyan development device 28 is activated. The latent image is inversely developed into a corresponding cyan toner image by the cyan development device 28. During this development, the developing roller 34 of the cyan development device 28 is subjected to a potential of +800 V. The black toner image, the yellow toner image, the magenta toner image, and the cyan toner image form a composite color toner image together on the photosensitive member 40.

The composite color toner image is transferred from the photosensitive member 40 to the sheet 46 by the transfer device 45. The sheet 46 which carries the composite color toner image is fed to the fusing device 47 by a suitable conveyor. The device 47 permanently affixes the composite color toner image to the sheet 46 in a thermal process.

After the composite color toner image is transferred from the photosensitive member 40 to the sheet 46, the surface of the photosensitive member 40 is charged to a positive potential by the charging device 48 and is then rubbed with the fur brush 49 so that the photosensitive member 40 is cleaned. During this cleaning process, the charging device 48 is operated at a corona voltage of +5.5 KV and the fur brush 49 is subjected to a voltage of −150 V.

It was experimentally found that, in a resulting color image, a composite color formed by red, green, and blue had a color density or strength equal to or higher than 1.5, and the cyan toner was prevented from entering red portions. Accordingly, the resulting color image had a high color purity and was clear. It was also experimentally found that the cyan toner remained prevented from entering red portions while image forming steps to obtain a composite color image were repeated a hundred times.

A second embodiment of this invention is similar to the first embodiment except for the following points. The second embodiment uses a minus corona charging device 44 in place of the ac corona charging device of the first embodiment. Accordingly, the charging device 44 includes a minus power supply.

The second embodiment operates as follows. A photosensitive member 40 is rotated at a peripheral speed of 160 mm/s. The photosensitive member 40 is charged to a potential of +900 V by a charging device 41 in a first charging process. During the first charging process, the charging device 41 is operated at a corona voltage of +7 KV and a grid voltage of +1 KV. After the first charging process, the photosensitive member 40 undergoes first exposure and is thus exposed to the light from a semiconductor laser 42 which represents a black-related information signal. The first exposure records the black-related information signal on the photosensitive member 40, forming a corresponding negative and thus forming an electrostatic latent image related to black. Only a black development device 38 is activated. The latent image is inversely developed into a corresponding black toner image by the black development device 38. During this development, a developing roller 39 of the black development device 38 is subjected to a potential of +600 V. After the development, a lamp 43 removes charges from the photosensitive member 40.

Next, the photosensitive member 40 is charged to a potential of +600 V by the charging device 41 in a second charging process. During the second charging process, the charging device 41 is operated at a corona voltage of +7 KV and a grid voltage of +600 V. As a result, portions of the photosensitive member 40 which carry the black toner assume a potential of +600 V. After the second charging process, the photosensitive member 40 undergoes second exposure and is thus exposed to the light from the semiconductor laser 42 which represents a yellow-related information signal. The second exposure records the yellow-related information signal on the photosensitive member 40, forming a corresponding negative and thus forming an electrostatic latent image related to yellow. Only a yellow development device 26 is activated. The latent image is inversely developed into a corresponding yellow toner image by the yellow development device 26. During this development, a developing roller 32 of the yellow development device 26 is subjected to a potential of +600 V. The lamp 43 is deactivated so that it will not remove charges from the photosensitive member 40.

Subsequently, the photosensitive member 40 is charged to a potential of +810 V by the charging device 41 in a third charging process. During the third charging process, the charging device 41 is operated at a corona voltage of +7 KV and a grid voltage of +800 V. As a result, portions of the photosensitive member 40 which carry the black and yellow toners assume a potential of +810 V. After the third charging process, the photosensitive member 40 undergoes third exposure and is thus exposed to the light from the semiconductor laser 42 which represents a magenta-related information signal. The third exposure records the magenta-related information signal on the photosensitive member 40, forming a corresponding negative and thus forming an electrostatic latent image related to magenta. Only a magenta development device 27 is activated. The latent image is inversely developed into a corresponding magenta toner image by the magenta development device 27. During this development, a developing roller 33 of the magenta development device 27 is subjected to a potential of +800 V. Portions of the photosensitive member 40 in which the yellow toner and the magenta toner overlap are formed with a toner layer having a thickness of 20–40 micrometers and having two or four sub-layers.

Next, the photosensitive member 40 is exposed to a dc corona potential of −5 KV by the corona charging device 44 and is then charged to a positive potential of +800 V by the charging device 41 in a fourth charging process. As a result of the fourth charging process, portions of the photosensitive member 40 which carry either of the black, yellow, and magenta toners assume a potential of +800 V. In addition, red portions of the photosensitive member 40 in which the yellow toner and the magenta toner overlap assume a potential of +800 V. After the fourth charging process, the photosensitive member 40 undergoes fourth exposure and is thus exposed to the light from the semiconductor laser 42 which represents a cyan-related information signal. The fourth exposure records the cyan-related information signal on the photosensitive member 40, forming a corresponding negative and thus forming an electrostatic latent image related to cyan. Only a cyan development device 28 is activated. The latent image is inversely developed into a corresponding cyan toner image by the cyan development device 28. During this development, a developing roller 34 of the cyan development device 28 is subjected to a potential of +800 V. The black toner image, the yellow toner image, the magenta toner image, and the cyan toner image form a composite color toner image together on the photosensitive member 40.

The composite color toner image is transferred from the photosensitive member 40 to a sheet 46 by a transfer device 45. A fusing device 47 permanently affixes the composite color toner image to the sheet 46 in a thermal process.

After the composite color toner image is transferred from the photosensitive member 40 to the sheet 46, the surface of the photosensitive member 40 is charged to a positive potential by a charging device 48 and is then rubbed with a fur brush 49 so that the photosensitive member 40 is cleaned. During this cleaning process, the charging device 48 is operated at a corona voltage of +5.5 KV and the fur brush 49 is subjected to a voltage of −150 V.

It was experimentally found that, in a resulting color image, a composite color formed by red, green, and blue had a color density or strength equal to or higher than 1.5, and the cyan toner was prevented from entering red portions. Accordingly, the resulting color image had a high color purity and was clear. It was also experimentally found that the cyan toner remained prevented from entering red portions while image forming steps to obtain a composite color image were repeated a hundred times.

What is claimed is:

1. A method of color electrophotography comprising the steps of:

(a) performing a charging process, an exposure process, and a development process to form a toner image on a photosensitive member for each of a plurality of different colors, wherein the toner images for the respective colors form a composite color image;

(b) transferring the composite color image to a sheet; and (c) varying a potential of toner on the photosensitive member before the development process for a final color is performed.

2. The method of claim 1 wherein the colors are yellow, magenta, and cyan respectively.

3. The method of claim 1 wherein the potential varying step follows the development process for a first color.

4. The method of claim 1 wherein the potential varying step follows the development process for a second color but precedes the charging process for a third color.

5. The method of claim 1 wherein the potential varying step comprises applying ac corona to the photosensitive member.

6. The method of claim 1 wherein the potential varying step comprises applying dc corona to the photosensitive member, the dc corona having a polarity opposite to a polarity of charge of the photosensitive member.

7. The method of claim 1 wherein the photosensitive member comprises amorphous selenium-based material.

8. The method of claim 1 wherein the photosensitive member comprises amorphous selenium-arsenic-based material.

9. The method of claim 1 wherein the photosensitive member comprises organic material.

10. An apparatus for color electrophotography comprising:

(a) means for performing a charging process, an exposure process, and a development process to form a toner image on a photosensitive member for each of a plurality of different colors, wherein the toner images for the respective colors form a composite color image;

(b) means for transferring the composite color image to a sheet; and (c) means for decreasing a quantity of charges of toner on the photosensitive member before the development process for a final color is performed.

11. The apparatus of claim 10 wherein the colors are yellow, magenta, and cyan respectively.

12. The apparatus of claim 10 wherein the decrease in the charge quantity follows the development process for a first color.

13. The apparatus of claim 10 wherein the decrease in the charge quantity follows the development process for a second color but precedes the charging process for a third color.

14. The apparatus of claim 10 wherein the charge decreasing means comprises means for applying ac corona to the photosensitive member.

15. The apparatus of claim 10 wherein the charge decreasing means comprises means for applying dc corona to the photosensitive member, the dc corona having a polarity opposite to a polarity of charge of the photosensitive member.

16. An apparatus for color electrophotography comprising:

(a) means for performing a charging process, an exposure process, and a development process to form a toner image on a photosensitive member for each of yellow, magenta, and cyan, wherein the yellow, magenta, and cyan toner images form a composite color image;

(b) means for transferring the composite color image to a sheet; and (c) means for varying a potential of toner on the photosensitive member after the magenta development process but before the cyan charging process.

17. The apparatus of claim 16 wherein the potential varying means comprises means for applying ac corona to the photosensitive member.

18. The apparatus of claim 16 wherein the potential varying means comprises means for applying dc corona to the photosensitive member, the dc corona having a polarity opposite to a polarity of charge of the photosensitive member.

19. An apparatus for color electrophotography comprising:

(a) a photosensitive member;

(b) means for charging the photosensitive member in a first charging process;

(c) means for, after the first charging process, exposing the photosensitive member to light representative of a first color information in a first exposure process and thereby forming a first electrostatic latent image corresponding to the first color information on the photosensitive member;

(d) a first color toner;

(e) means for developing the first electrostatic latent image into a corresponding first color toner image by use of the first color toner in a first development process;

(f) means for, after the first development process, varying a potential of a portion of the photosensitive member which carries the first color toner;

(g) means for, after the potential variation, charging the photosensitive member in a second charging process;

(h) means for, after the second charging process, exposing the photosensitive member to light representative of a second color information in a second exposure process and thereby forming a second electrostatic latent image corresponding to the second color information on the photosensitive member;

(i) a second color toner; and (j) means for developing the second electrostatic latent image into a corresponding second color toner image by use of the second color toner in a second development process, wherein the first and second color toner images form a composite color toner image.

20. The apparatus of claim 19 wherein the potential varying means comprises means for decreasing the potential of the portion of the photosensitive member which carries the first color toner.

21. A method of color electrophotography comprising the steps of:

performing a charging process, an exposure process, and a development process to form a toner image on a photosensitive member of each of a plurality of different colors, wherein the toner images for the respective colors form a composite color image;

transferring the composite color image to a sheet; and lowering a potential of toner on the photosensitive member before the following development process for a final color is performed.

22. A method of color electrophotography comprising the steps of:

performing a charging process, an exposure process, and a development process to form a toner image on a photosensitive member for each of a plurality of different colors, wherein the toner images for the respective colors form a composite color image;

transferring the composite color image to a sheet; and lowering a potential of a toner portion comprised of superposition with two colors on the photosensitive member before the following development process for a final color is performed.

23. A method of color electrophotography comprising the steps of:

performing a charging process, an exposure process, and a development process to form a toner image on a photosensitive member for each of the yellow, magenta, and cyan colors, wherein the toner images for the respective colors form a composite color image;

transferring the composite color image to a sheet; and lowering a potential of the toner in the magenta color portion of the photosensitive member before the following development process for the cyan color is performed.

* * * * *